US006038880A

United States Patent [19]

Oh

[11] Patent Number: 6,038,880

[45] Date of Patent: Mar. 21, 2000

[54] REFRIGERATOR HAVING A DEVICE FOR GENERATING AN AIR CURTAIN

[75] Inventor: Min-Jung Oh, Incheon, Rep. of Korea

[73] Assignee: Daewoo Electronics Co., Ltd., Seoul, Rep. of Korea

[21] Appl. No.: 08/867,425

[22] Filed: Jun. 6, 1997

[51] Int. Cl.[7] ..... F25D 17/08

[52] U.S. Cl. ..... 62/408; 62/256

[58] Field of Search ..... 62/256, 408, 419, 62/426; 454/193

[56] References Cited

U.S. PATENT DOCUMENTS 4,379,391 4/1983 Rhee ..... 62/408
5,765,388 6/1998 Jeon ..... 62/408
5,784,895 7/1998 Choi ..... 62/256
5,896,752 4/1999 Park ..... 62/256

*Primary Examiner*—William E. Tapolcai
*Attorney, Agent, or Firm*—Smith, Gambrell & Russell, LLP; Beveridge, DeGrandi, Weilacher & Young Intellectual Property Group

[57] ABSTRACT

A refrigerator has a blowing fan being capable of blowing bilaterally in a cool air duct. When a door is opened, the blowing fan blows to discharge cool air from the cool air duct, so the air curtain for shutting off a cooling compartment is generated. When the door is closed, the blowing fan blows to draw cool air in the cooling compartment into the cool air duct, so the circulation of the cool air is actively performed, and the cooling efficiency is enhanced.

4 Claims, 3 Drawing Sheets

REFRIGERATOR HAVING A DEVICE FOR GENERATING AN AIR CURTAIN

Background of the Invention

1. Field of the Invention

The present invention relates to a refrigerator in which the operation for generating an air curtain to prevent the loss of cool air and for drawing cool air to circulate the cool air through a cool air duct are selectively performed according to the opening/closing of a door.

2. Prior Art

FIG. 1 shows a conventional refrigerator, which shows a refrigerator having a device for generating an air curtain for shutting off the opening of a cooling compartment. The refrigerator has, as shown in FIG. 1, a cabinet 10 forming a freezing compartment 21 and a fresh food compartment 22 which are partitioned from each other by a wall 27, and a freezing compartment door 24 and a fresh food compartment door 25 which open/close the freezing compartment 21 and fresh food compartment 22 respectively.

A compressor 23 is installed in a lower rear part of the cabinet 10, and an evaporator 29 for generating cool air by evaporating refrigerant supplied from the compressor 23 is installed in the rear of the freezing compartment 21. Cooling fans 19 for blowing the cool air generated by the evaporator 29 is installed at the upper side of the evaporator 29. The cooling fans 19 consist of two fans to supply the freezing compartment 21 and the fresh food compartment 22 with the cool air respectively.

A device 20 for generating an air curtain is provided in the upper side of the fresh food compartment 22. The air curtain generating device 20 comprises a cool air duct 13 provided in the upper side of the fresh food compartment 22, and a blowing fan 11 for blowing the cool air from the evaporator 29 into the cool air duct 13. The cool air duct 13 is formed with a cool air discharge port 15 at one end thereof which is opened downward at the area adjacent to an opening of the fresh food compartment 22. The cool air blown into the cool air duct 13 is discharged downward, by which the air curtain for shutting off the opening of the fresh food compartment 22 is generated.

In the fresh food compartment 22, a sensor (not shown) for sensing the opening/closing of the fresh food compartment door 25 is provided, and the blowing fan 11 is controlled to operate only when the open state of the door 25 is sensed by the sensor. Thus, the air curtain is generated only when the door 25 is open so as to prevent leakage of the cool air through the opening of the fresh food compartment 22 at the open state of the door 25.

A plurality of cool air ports 16, 18 are formed at the rear walls of the freezing compartment 21 and the fresh food compartment 22. When the door 25 is closed, the cool air from the evaporator 29 is blown by the cooling fan 19 to be supplied into the freezing compartment 21 and the fresh food compartment 22, and accordingly the foodstuffs stored in the freezing compartment 21 and the fresh food compartment 22 are frozen and refrigerated respectively.

The cool air supplied in the fresh food compartment 25 through the cool air ports 18 circulates toward the evaporator 29 through the cool air duct 13. The cool air duct 13 functions as a discharge duct for generating the air curtain when the door 25 is open and as a circulation duct for circulating the cool when the door is close.

However, such a conventional refrigerator having the air curtain generating device is burdened with the problem that the cool air having cooled the foodstuffs in the fresh food compartment 25 is not circulated smoothly, whereby the cooling efficiency in the fresh food compartment 25 becomes low. That is, since the cool air duct 13 merely provides the passage through which the cool air moves toward the evaporator 29 and does not function to circulate the cool air in an active fashion, the circulation of the cool air depends only on the blowing power of the cooling fans 19, so the supply and return of the cool air are not smoothly performed. Also, since the blowing fan 11 which is possible to blow more strongly than the cooling fan 19 is used merely for generating the air curtain, the usage of the blowing fan 11 is confined.

SUMMARY OF THE INVENTION

The present invention has been proposed to overcome the above described problems in the prior art, and accordingly it is an object of the present invention to provide a refrigerator in which the circulation of the cool air is smoothly performed so that the cooling efficiency thereof is enhanced and the usage of the blowing fan is varied.

To achieve the above object, the present invention provides a refrigerator having a cabinet forming a cooling compartment which has an open side, a door for opening/closing an opening of said cooling compartment, and an evaporator for generating cool air, said refrigerator comprising: a cool air duct having ports at both ends which are opened at areas adjacent to said evaporator and the opening of said cooling compartment respectively; a blowing fan installed in said cool air duct, said blowing fan being capable of blowing bilaterally along a longitudinal direction of said cool air duct; a means for sensing whether said door is opened or closed; and a control part for controlling said blowing fan in order to convert a blowing direction according to sensing results of said sensing means, whereby an air curtain for shutting off the opening of said cooling compartment is generated by discharging the cool air from said evaporator through the port opened in said cooling compartment when said door is opened, and air in said cooling compartment is drawn into said cool air duct through the port opened in said cooling compartment when said door is closed.

It is preferable that a cross flow fan is adopted as said blowing fan, and in that situation, said cross flow fan is disposed to be capable of discharging the cool air from said cool air duct in a forward rotational direction in which said cross flow fan blows at a strong force and to draw the cool air into said cool air duct in a reverse rotational direction in which said cross flow fan blows at a weak force.

BRIEF DESCRIPTION OF THE DRAWINGS

The present invention will be better understood and its various objects and advantages will be more fully appreciated from the following description taken in conjunction with the accompanying drawings, in which.

DETAILED DESCRIPTION OF THE PREFERRED EMBODIMENT

Hereinafter, the present invention will be described in detail with reference to the drawings.

Figure 1:
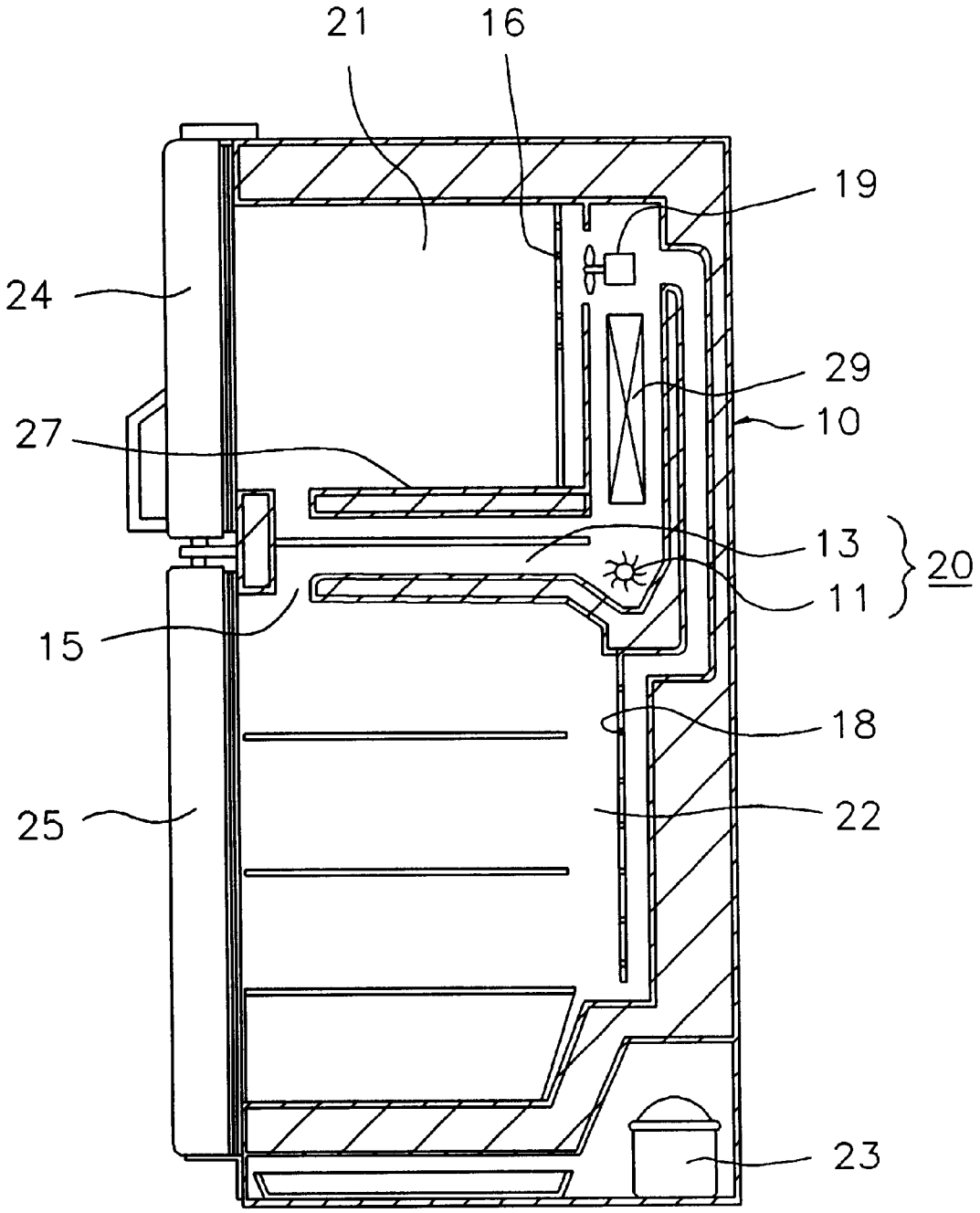
FIG. 1 PRIOR ART
FIG. 1 is a side sectional view of a conventional refrigerator having air curtain generating device.
Figure 2:
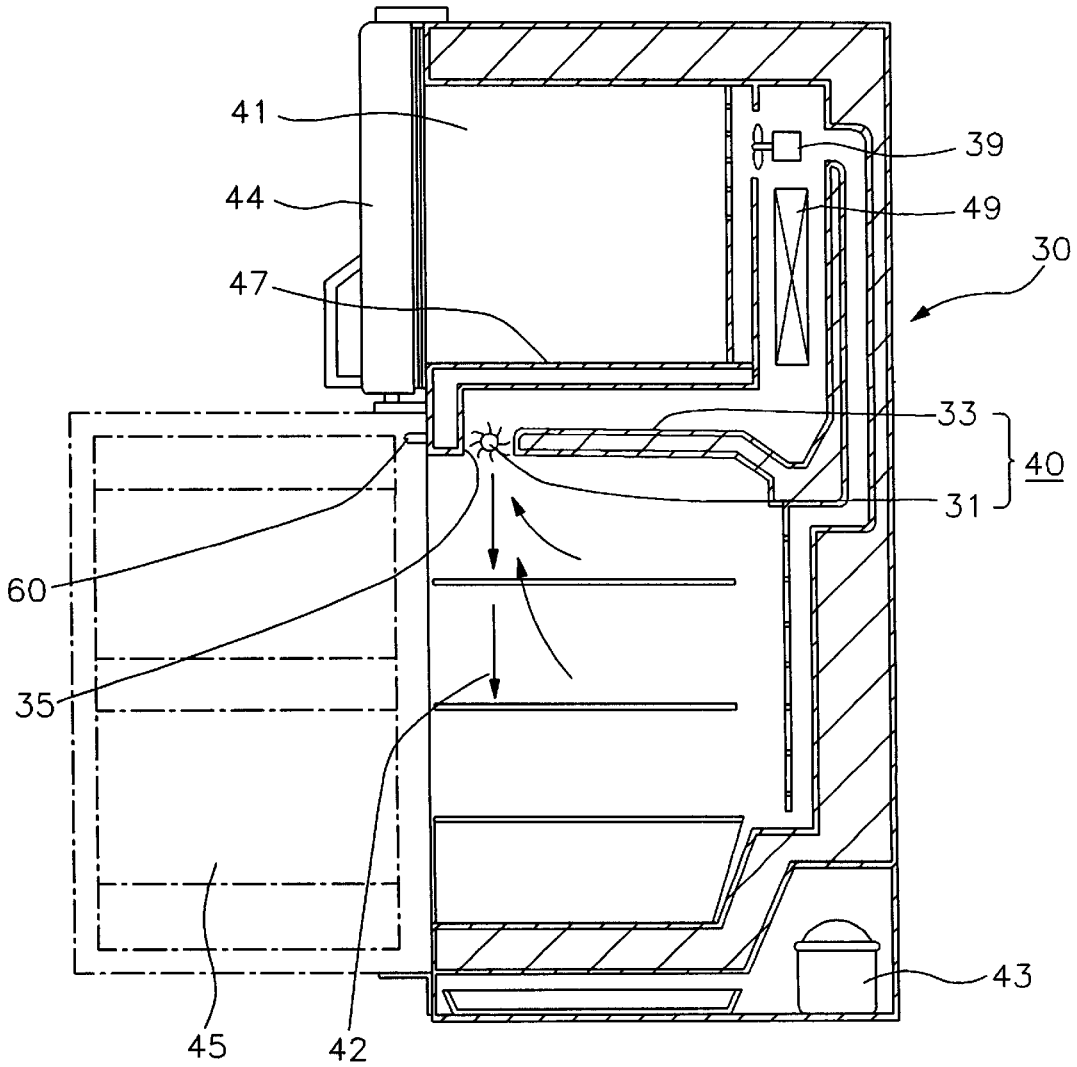
FIG. 2 is a side sectional view of a refrigerator according to the present invention.
Figure 3:
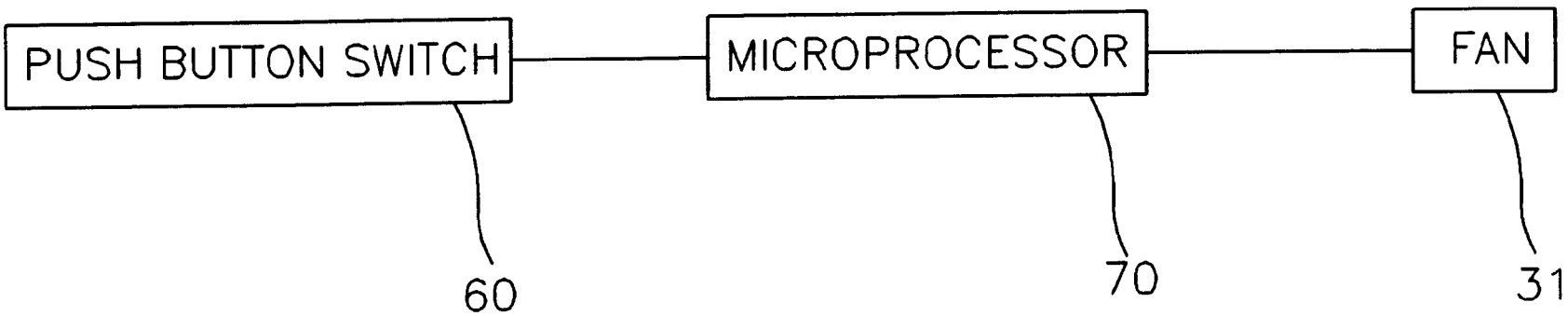
FIG. 3 is a block diagram of the control circuit for controlling the blowing fan in FIG. 2.

FIG. 2 is a side sectional view of a refrigerator according to the present invention, and FIG. 3 is a block diagram of the control circuit for controlling the blowing fan in FIG. 2. The refrigerator according to the present invention has, like the conventional refrigerator shown in FIG. 1, a cabinet 30 forming a freezing compartment 41 and a fresh food compartment 42 which are partitioned from each other by a wall 47, and a freezing compartment door 44 and a fresh food compartment door 45 which open/close the freezing compartment 41 and fresh food compartment 42 respectively.

A compressor 43 is installed in a lower rear part of the cabinet 30, and an evaporator 49 for generating cool air by evaporating refrigerant supplied from the compressor 43 is installed in the rear of the freezing compartment 41. At the upper side of the evaporator 49, a cooling fan 39 for blowing the cool air generated by the evaporator 49 is installed to supply the freezing compartment 41 and the fresh food compartment 42 with the cool air.

A device 40 for generating an air curtain which shuts off the opening of the fresh food compartment 42 according to the opening of the fresh food compartment door 45 is provided in the upper side of the fresh food compartment 42. The air curtain generating device 40 comprises a cool air duct 33 provided in the upper side of the fresh food compartment 42 and a blowing fan 31 for blowing the cool air from the evaporator 49 into the cool air duct 33. The cool air duct 33 is formed with a cool air discharge port 35 at one end thereof which is opened downward at the area adjacent to the opening of the fresh food compartment 42. The cool air blown into the cool air duct 33 is discharged downward, by which the air curtain for shutting off the opening of the fresh food compartment 42 is generated.

The blowing fan 31 is capable of rotating in a bilateral direction, so the blowing fan 31 may possibly blow bilaterally along the longitudinal direction of the cool air duct 33. Also, for the blowing fan 31, a cross flow fan which is capable of blowing uniformly is adopted, and the cross flow fan is disposed near the cool air discharge port 35 in the cool air duct 33. The blowing power of the cross flow fan differs in both rotational directions thereof. Assuming the rotational directions as a forward direction and a reverse direction in which the blowing power of the cross flow fan is strong and weak respectively, in the present invention the cross flow fan is disposed so that the cool air in the cool air duct 33 is discharged through the cool air discharge port 35 when the blowing fan 31 rotates in the forward direction, and the cool air in the fresh food compartment 25 is drawn through the cool air discharge port 35 when the blowing fan 31 rotates in the reverse direction.

A push button switch 60 is installed on the front surface of the fresh food compartment 42. The push button switch 60 is pushed by the door 45 when the door 45 is closed and released when the door 45 is opened. A microprocessor 70 installed in the refrigerator senses that the door 45 is opened when the push button switch 60 is released. The microprocessor 70 drives the blowing fan 31 according to the state of the door 45 sensed through the push button switch 60. That is, the microprocessor 70 rotates the blowing fan 31 in the forward direction in order to generate the air curtain when the door 45 is opened, and in the reverse direction in order to draw the cool air in the fresh food compartment 42 into the cool air duct 33. The cool air drawn into the cool air duct 33 is circulated to the evaporator 39. The circulated air is cooled by the evaporator 39 again, and blown by the cooling fan 19 to be supplied into the fresh food compartment 42.

Since the air in the fresh food compartment 42 is circulated by force, the circulation of the cool air into the fresh food compartment 42 is actively performed, and the cooling efficiency of the fresh food compartment 42 is enhanced. Especially, since the air in the fresh food compartment 42 is drawn by the blowing fan 31 used for generating the air curtain which may possibly blow strongly, the supply and the circulation of the cool air in the fresh food compartment 42 is sufficiently performed without the extra fans, except for the cooling fan 39.

As described above, according to the present invention, the refrigerator in which the cool air is smoothly circulated and the cooling efficiency in the fresh food compartment 42 is enhanced is provided.

Although the present invention has been described and illustrated in detail, it is clearly understood that the same is by way of illustration and example only and is not to be taken by way of limitation, wherein the spirit and scope of the present invention is limited only by the terms of the appended claims.

What is claimed is:

1. A refrigerator having a cabinet forming a cooling compartment which has an open side, a door for opening/closing an opening of said cooling compartment, and an evaporator for generating cool air, said refrigerator comprising:

a cool air duct having ports at both ends which are opened at areas adjacent to said evaporator and the opening of said cooling compartment respectively;

a blowing fan installed in said cool air duct, said blowing fan being capable of blowing bilaterally along a longitudinal direction of said cool air duct;

a means for sensing whether said door is opened or closed; and a control part for controlling said blowing fan in order to convert a blowing direction according to sensing results of said sensing means, whereby an air curtain for shutting off the opening of said cooling compartment is generated by discharging the cool air from said evaporator through the port opened in said cooling compartment when said door is opened, and air in said cooling compartment is drawn into said cool air duct through the port opened in said cooling compartment when said door is closed.

2. The refrigerator as claimed in claim 1, wherein said blowing fan is a cross flow fan.

3. The refrigerator as claimed in claim 2, wherein said cross flow fan is disposed to be capable of discharging the cool air from said cool air duct in a forward rotational direction in which said cross flow fan blows at a strong force, and to draw the cool air into said cool air duct in a reverse rotational direction in which said cross flow fan blows at a weak force.

4. The refrigerator as claimed in claim 1, wherein said sensing means is a push button switch installed on said cabinet, said push button switch being pushed and released by said door when said door is opened and closed respectively.

* * * * *